United States Patent [19]

Thompson

[11] Patent Number: 4,856,667

[45] Date of Patent: Aug. 15, 1989

[54] CONTAINER AND CAP

[75] Inventor: Mortimer S. Thompson, Maumee, Ohio

[73] Assignee: Tri-Tech Systems International Inc., Maumee, Ohio

[21] Appl. No.: 63,118

[22] Filed: Jun. 17, 1987

[51] Int. Cl.[4] ..... B65D 41/04

[52] U.S. Cl. ..... 215/318; 215/31; 215/337; 215/344; 215/DIG. 1

[58] Field of Search ..... 215/DIG. 1, 222, 223, 215/31, 209, 318, 337, 344; 53/485, 486, 490

[56] References Cited

U.S. PATENT DOCUMENTS

| | | |
|---|---|---|
| 521,788 | 6/1894 | Flanigan . |
| 953,513 | 7/1910 | Love . |
| 1,770,548 | 7/1930 | Oven . |
| 2,340,353 | 2/1944 | Weaver . |
| 2,385,105 | 5/1959 | Heyl et al. . |
| 2,423,295 | 7/1947 | Crabbe et al. . |
| 2,447,340 | 8/1948 | Jackson . |
| 2,456,560 | 12/1948 | Keith . |
| 2,852,054 | 9/1958 | Motley . |
| 2,961,119 | 11/1960 | Leach . |
| 3,038,624 | 6/1962 | Wieckmann . |
| 3,065,677 | 11/1962 | Loeser . |
| 3,171,458 | 3/1965 | Strong . |
| 3,200,981 | 8/1965 | Harding . |
| 3,243,851 | 4/1966 | Reitter, Jr. et al. . |
| 3,250,417 | 5/1966 | Powers, Jr. et al. . |
| 3,272,369 | 9/1966 | Grimsley . |
| 3,285,452 | 11/1966 | Moloney et al. . |
| 3,286,866 | 11/1966 | McIntosh . |
| 3,339,770 | 9/1967 | Weigand . |
| 3,343,700 | 9/1967 | Heubl . |
| 3,344,942 | 10/1967 | Hedgewick . |
| 3,348,717 | 10/1967 | Treanor . |
| 3,352,127 | 11/1967 | Skinner, Sr. . |
| 3,352,448 | 11/1967 | Livingstone . |
| 3,361,551 | 1/1975 | Hannon . |
| 3,374,913 | 3/1968 | Zipper . |
| 3,405,439 | 10/1968 | Uemura . |
| 3,418,409 | 12/1968 | Hesse et al. . |
| 3,460,703 | 8/1969 | Leftault, Jr. . |
| 3,482,725 | 12/1969 | Exton . |
| 3,532,786 | 10/1970 | Coffman . |
| 3,557,275 | 1/1971 | Longshaw et al. . |
| 3,557,985 | 1/1971 | St. Denis et al. . |
| 3,567,233 | 3/1971 | Stephanich . |
| 3,612,324 | 10/1971 | Malick . |
| 3,613,929 | 10/1971 | Treanor . |
| 3,784,041 | 1/1974 | Birch . |
| 3,820,799 | 6/1974 | Abbes et al. . |
| 4,016,996 | 4/1977 | Aichinger et al. . |
| 4,069,937 | 1/1978 | Smalley . |
| 4,090,631 | 5/1978 | Grussen . |
| 4,091,948 | 5/1978 | Northup . |
| 4,141,463 | 2/1979 | Smith . |
| 4,143,785 | 3/1979 | Ferrell . |
| 4,153,172 | 5/1979 | Bialobrzeski . |
| 4,196,818 | 4/1980 | Brownbill . |
| 4,202,462 | 5/1980 | Imber . |
| 4,206,852 | 6/1980 | Dunn et al. . |
| 4,209,102 | 6/1980 | Dunn et al. . |
| 4,210,251 | 7/1980 | Grussen . |
| 4,218,067 | 8/1980 | Halling . |
| 4,253,581 | 3/1981 | Aichinger et al. . |
| 4,257,525 | 3/1981 | Thompson . |

(List continued on next page.)

FOREIGN PATENT DOCUMENTS

| | | |
|---|---|---|
| 764429 | 3/1971 | Belgium . |
| 0049876 | 10/1981 | European Pat. Off. . |
| 1811318 | 7/1969 | Fed. Rep. of Germany . |
| 2829755 | 1/1980 | Fed. Rep. of Germany . |

OTHER PUBLICATIONS

Cyrogenics (Jul. 1980)–M. Shinohara, T. Kugo, and K. Ono, Superleak–Tight Stainless Steel Hollow O–Ring Seals for Cryogenic Use.

*Primary Examiner*—Donald F. Norton

*Attorney, Agent, or Firm*—Hedman, Gibson, Costigan & Hoare

[57] ABSTRACT

Closure systems including a container having an annular projection integral with the lip of the container having a curled free end portion for engaging a cap and methods of forming and using the same.

13 Claims, 3 Drawing Sheets

U.S. PATENT DOCUMENTS

| | | |
|---|---|---|
| 4,274,544 | 6/1981 | Westfall . |
| 4,281,774 | 8/1981 | Mumford . |
| 4,281,979 | 8/1981 | Doherty . |
| 4,290,614 | 9/1981 | Moll . |
| 4,343,408 | 8/1982 | Csaszar . |
| 4,345,692 | 8/1982 | Obrist et al. . |
| 4,360,114 | 11/1982 | Owens . |
| 4,360,149 | 11/1982 | Hein . |
| 4,386,044 | 5/1983 | Arndt et al. . |
| 4,392,579 | 7/1983 | Uhlig et al. . |
| 4,394,918 | 7/1983 | Grussen . |
| 4,418,828 | 12/1983 | Wilde et al. . |
| 4,442,947 | 4/1984 | Banich, Sr. . |
| 4,470,513 | 9/1984 | Ostrowsky . |
| 4,475,274 | 10/1984 | Beckstrom et al. . |
| 4,497,765 | 2/1985 | Wilde et al. . |
| 4,506,795 | 3/1985 | Herr . |
| 4,550,844 | 11/1985 | Lininger . |
| 4,552,279 | 11/1985 | Mueller et al. . |
| 4,563,325 | 1/1986 | Coffman . |
| 4,595,547 | 6/1986 | Herr . |
| 3523771 | 1/1987 | Fed. Rep. of Germany . |
| 555488 | 3/1923 | France . |
| 2306135 | 4/1976 | France . |
| 2378689 | 1/1978 | France . |
| 351515 | 1/1961 | Switzerland . |
| 607702 | 8/1975 | Switzerland . |
| 788148 | 8/1956 | United Kingdom . |
| 930866 | 8/1956 | United Kingdom . |
| 1024762 | 10/1962 | United Kingdom . |
| 1048727 | 3/1965 | United Kingdom . |

FIG. 1
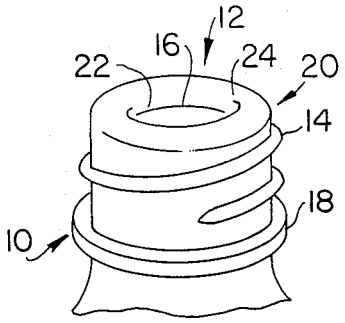
FIG. 2
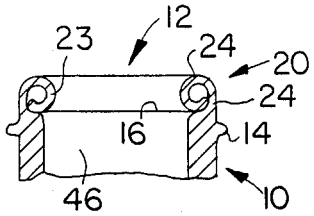
FIG. 3
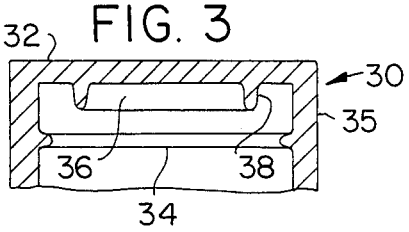
FIG. 4
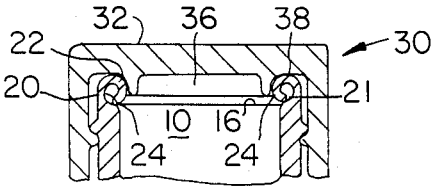
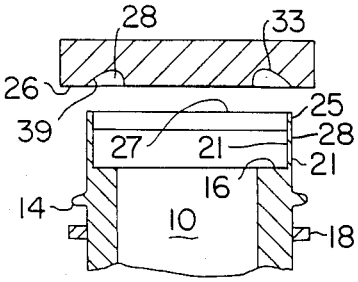
FIG. 5
FIG. 7
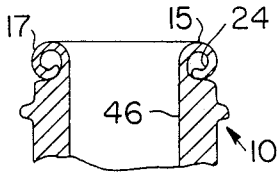
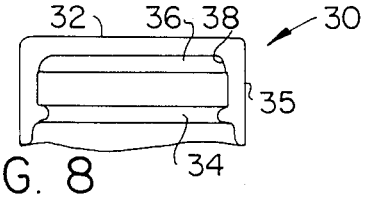
FIG. 8
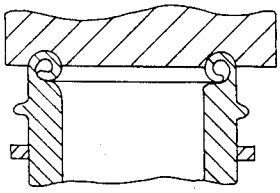
FIG. 6
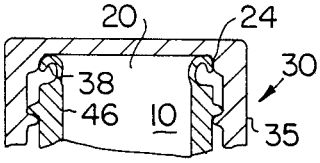
FIG. 9

FIG. 10
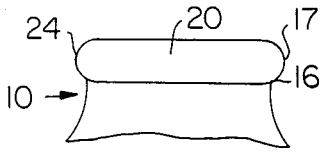
FIG. 11
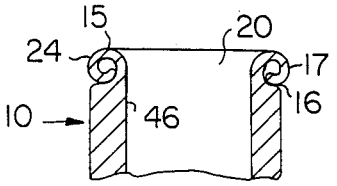
FIG. 12
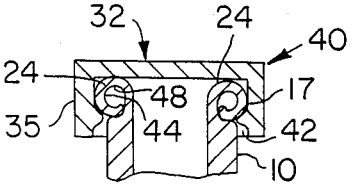
FIG. 13
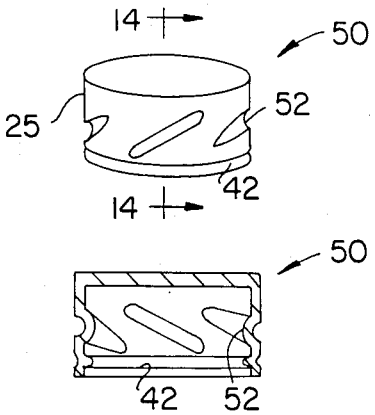
FIG. 14
FIG. 15
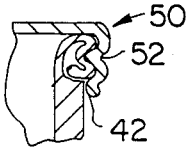
FIG. 16
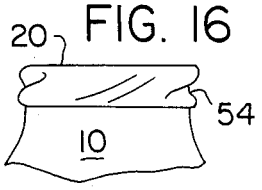
FIG. 17
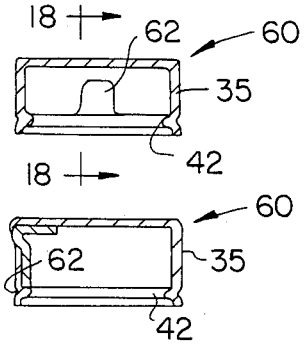
FIG. 18
FIG. 19
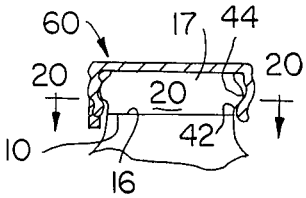
FIG. 20
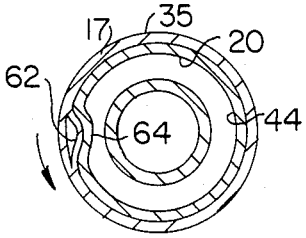

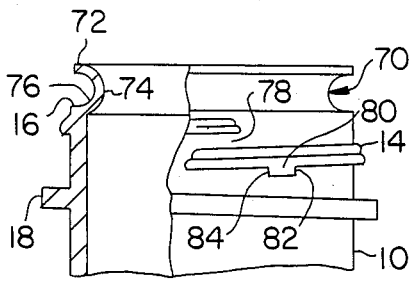
FIG. 21
FIG. 22
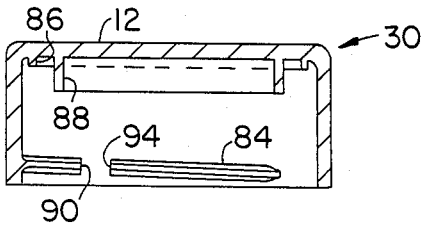
FIG. 23
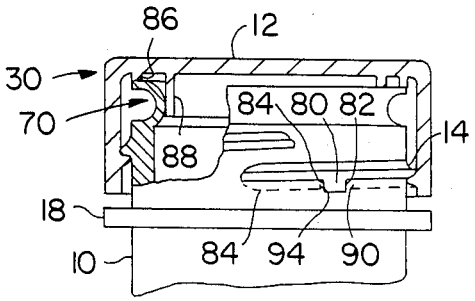

CONTAINER AND CAP

FIELD OF THE INVENTION

This invention relates containers and to means particularly on the container to assure consistent levels of sealing performance and application and uncapping torques. The invention also relates to methods of forming such caps.

BACKGROUND OF THE INVENTION

A great deal of attention has been focused by the packaging industry on efforts with twist caps to achieve consistent closure sealing performance and consistent levels of capping torques. A basic problem exists with the construction of the closures and with the methods and machinery used to apply caps to containers. This problem results in large variations of the torque required by the consumer to remove such caps so that some demand unusual strength or special implements while others may be so loosely applied that the effectiveness of their seal has been compromised.

It is therefore an object of the invention to provide a closure system with superior sealing qualities.

It is a further object of the invention to provide a container neck finish with means for engaging a cap to provide superior sealing characteristics.

SUMMARY OF THE INVENTION

In accordance with the present invention there is provided a new and unique closure system consisting of a container neck and a cap wherein the container neck finish includes a curled functional portion. The container has an opening for dispensing product, a surrounding neck which includes plastic material and has a finish with an engaging means for engaging the cap and an integral generally vertical wall with a curved free end for cooperating with the cap for sealing, for closing, for closing and opening and/or for urging the closing means together to provide additional functions such as stopping and/or locking the closure engaging means. The cap has a top wall which covers the container opening and a depending skirt which engages the finish of the container for closure thereof and means for cooperating with the container neck for sealing the container.

In a preferred embodiment the curled free end of the container neck extends upwardly from its rim and provides a highly compressible sealing element having a "U", "J" or "O" shape radial cross section. The curled free end may face outwardly and its inner surface may cooperate with the cap to form a seal, but preferably the seal is formed on its upper surface and still more preferably on its outer surface where its compressibility is greatest. Alternatively the curled free end may face inwardly to preferably form a seal on its inner surface for a plug type cap. Such a seal has the advantage of offering a superior sealing surface in a location where sealing pressure and uncapping torque levels may be readily controlled and which is protected from marring during handling between container manufacture and the capping operation.

In another embodiment the curled free end of the neck seal is impressed by thread portions of a cap upon capping to form matching threads which are used to remove the cap from the container by twisting it.

In yet another embodiment the curled free end of the neck seal is impressed by a projection from the cap skirt upon capping which then serves to break the seal where the cap is twisted to release a vacuum or pressure to facilitate cap removal.

In another embodiment, the curled free end of the neck seal is employed as a spring to constantly urge cap and neck threads together into a locked engagement, whereby to unlock the cap it must first be depressed against the spring action of the neck seal.

BRIEF DESCRIPTION OF THE DRAWINGS

The following drawings in which like reference characters indicate like parts are illustrative embodiments of the invention and are not intended to limit the scope of the invention as set forth in the claims forming part of the application.

FIG. 1 is a perspective view of a container neck of he present invention.

FIG. 2 is a partial sectional view of the container neck of FIG. 1.

FIG. 3 is a partial sectional view of a cap employed in the closure system of the present invention.

FIG. 4 is a sectional view of a cap and a container of the present invention.

FIG. 5 is a sectional view of a curling tool used to form the container neck.

FIG. 6 is a sectional view showing the curling tool shown in FIG. 5 forming the container neck.

FIG. 7 is a sectional view showing a container neck having an annular projection with a curled free end portion curled outwardly.

FIG. 8 is a perspective view of a cap used to engage the container neck shown in FIG. 7.

FIG. 9 is sectional view of the cap and container shown in FIG. 8.

FIG. 10 is a perspective view of an 0-shaped seal of the container engaged by a cap.

FIG. 11 is a sectional view of the container neck shown in FIG. 10.

FIG. 12 is sectional view of the cap and container shown in FIG. 10.

FIG. 13 is a perspective view of a cap having threaded portions on its depending skirt.

FIG. 14 is a sectional view of the cap shown in FIG. 13.

FIG. 15 is a partial sectional view of the engagement between the cap of FIG. 13 and a container.

FIG. 16 is a perspective view showing the sealing portion of a container neck having thread portions formed by a cap.

FIG. 17 is a sectional view of a cap sealed to a container.

FIG. 18 is a sectional view taken through line 10—10 of FIG. 17.

FIG. 19 is a sectional view of a cap in a snapped-on position on a container.

FIG. 20 is a sectional view of the embodiment shown in FIG. 19.

FIG. 21 is a partial sectional view of a container neck having positive locking and stopping means.

FIG. 22 is a sectional view of a cap for engaging the container neck of FIG. 21.

FIG. 23 is a partial sectional view of the cap of FIG. 22.

DETAILED DESCRIPTION OF THE DRAWINGS

Referring to FIGS. 1 to 4 there is shown a container neck 10 having a thread 14 for engaging a cap, an annular bead 18, an opening 12 with a rim 16 surrounding said opening 12 and an "O" shape sealing portion 20 integral with the rim 16 having a curled free end 24 directed inwardly and an attached end 21. The curled free end 24 has an inner surface 13 used for sealing. There is also shown a cap 30 having a skirt 35, a thread 34, a top wall 32 with a depending linerless seal 36 with an outside sealing surface 38. FIG. 4 shows the cap 30 in closed and sealed engagement with the container neck 10 wherein the cap linerless seal 36 and its sealing surface 38 has been easily forced into the neck opening 12 to compress the curled free end 24 and create a seal with its sealing surface 13. Such a plug type seal has the advantage of offering a superior sealing surface, and because the sealing force is determined by the relative diameters of the sealing surfaces 13 and 38 as well as the high compressibility of the curled free end 24 it also produces a consistent level of sealing and uncapping force. Additionally the sealing surfaces 13 and 38 are both in a location where they are protected from incidental scratching or marring after manufacture and before capping.

Bottle neck finishes for the invention typically range from under 20 mm to 120 mm and bottle and/or jar sizes range from under 2 ounce to 128 ounce capacity. Larger capacity containers such as drums or kegs are also suitable for the practice of the invention as are smaller vials and other containers.

Useful plastics which can be used for forming the container necks and seals of the invention include polypropylene, polyethylene, polyvinylchloride, polyethylene terephthalate and may other semi-rigid to rigid plastic materials.

The neck seals of the present invention can be used in a wide variety of containers including combinations with other materials (e.g., metal containers having plastic neck finish portions). Such seals may be used to close and seal a wide variety of products including: beverages, including carbonated soft drinks and pasteurized beverages such as beer; foods, especially those where container sealing performance is critical, including oxygen sensitive ones such as mayonnaise, peanut butter and salad oil, and including corrosive ones such as vinegar, lemon juices; and household chemicals, including bleaches and detergents, drugs and cosmetics and other products requiring the highest integrity seal and reseal under the widest range of distribution and use conditions.

Further, the neck seals of the present invention can be used in conjunction with caps having a liner or linerless seals and may employ various or all surfaces of the neck seal 20. Moreover, the neck seals of the present invention can be used with a wide variety of caps, including snap caps and threaded caps with or without breakaway rings. Specifically, the neck seals of the present invention can be used with the caps having the breakaway or separable rings disclosed in my U.S. patent application Ser. No. 809,057, filed on Dec. 12, 1985 and issued on Dec. 1, 1987 as U.S. Pat. No. 4,709,824 and incorporated herein by reference. Furthermore, the neck seals of the invention may be used with similar seals in linerless caps disclosed in my U.S. patent application Ser. No. 809,058, filed on Dec. 12, 1985, and issued on Nov. 24, 1987 as U.S. Pat. No. 4,708,255 and incorporated herein by reference.

Referring to FIGS. 5 and 6 there is shown a preferred method of forming the curled portion 24 of the neck sealing portion 20. In FIG. 5 the neck 10 already has been formed by conventional molding techniques, such as injection, compression or blow molding, with a vertical cylindrical or tubular wall 23 having its lower end 21 integral with the neck top wall 16 and with its upper free end 25 ready for curling by the illustrated curling tool 26. As shown in FIG. 5, there is a taper in the upper end 25 extending from the rim 27 which facilitates the initiation of the curl 24 and the wall 23 and the curl 24 are free of abrupt changes in thickness.

The curled portion 24 is formed with a curling tool 26, which in FIG. 5 has been positioned above the neck 10 ready to engage the preformed wall 23 at its rim 27. The curling tool 26 includes an annular groove 28 of a concave cross section suitable for shaping and dimensioning the curled portion 24.

As shown in FIGS. 5 and 6, the forming operation is accomplished by pressing the groove 28 of the tool 26 against the rim 27 of the wall 23. In this embodiment the deepest portion 33 of the groove 28 representing the center of its concavity is located inwardly of the cylindrical plane of the wall 23. Also the groove 28 has a slanted portion 39 outwardly and tangent to is concavity to facilitate centering the tool 26 and neck 10. As movement of tool 26 relative to the wall 23 continues toward the neck top wall 16, the cylindrical sides of the wall 23 are centered within groove 28 by the slanted portions 39 and are then forced inwardly and then downwardly to assume the desired curved shape having a curved cross section of from about 90 to 360 degrees but preferably from about 180 to 300 degrees.

To facilitate the curling operation, in the case of polypropylene, the tool 26 may be at a temperature of about ambient to about 300 degrees F for curling cycles of about one-half to seconds. The curl radius of the groove 28 and the resultant curled free end 24 may range from 0.030 to 0.100 inches or larger when used in conjunction with wall 23 thicknesses of about 0.005 to 0.030 inches. The thickness of wall 23 may desirably be tapered to include free ends 25 of about 0.005 to 0.015 inches and lower ends 21 of from 0.010 to 0.030 inches.

Referring now to FIGS. 7 to 9 there is shown another embodiment of the invention wherein the attachment site 21 of the preform wall 23 is at the neck inner wall 46 and the curled free end 24 faces outwardly and is "J" shape in cross section. The cap 30 has a linerless seal 36 and a sealing surface 38 designed to engage the neck curled free end 24 at its upper sealing surface 15 and its outer sealing surface 17.

Referring to FIGS. 10 to 12 there is shown a curled free end 24 which is "O" shape in cross section and facing outwardly in closed and sealed engagement with a snap cap 40. The cap 40 has an annular bead 42 which upon capping develops an interference with the outer neck seal portion 17 which in turn seals against the inside surface 44 of the cap skirt 35 and the bottom surface 48 of the cap lid 32.

FIGS. 13 to 16 illustrate another embodiment of the invention whereby the neck seal 20 shown in FIGS. 11 and 12 cooperates with the cap 50 to produce a snap-on, twist-off capping and uncapping operation. The cap 50 is preferably metal and has thread portions 52 and a lower interfering bead 42 on its skirt 35. The cap 50 is preferably at an elevated temperature when it is applied by a press-on, snap-fit method to the neck 10 with its seal portion 20. The seal 20 is then impressed by the cap thread portions 52 to form matching thread portions 54 so that it may subsequently be removed from the container neck by twisting it. Such a closure system is particularly suited for vacuum packaged products where fill and capping temperatures are high.

Referring now to FIGS. 17 to 20 there is shown another embodiment of the invention also suited for vacuum packed products wherein the cap 60 is pressed or snapped on to the container neck and whereby it is snapped off after the seal is broken and the vacuum is released by first twisting it. The cap 60 has a skirt 35 and an annular internal bead 42 below an inner projection 62. When the cap 60 is applied to the container neck 10 illustrated in FIGS. 11 and 12 with its seal portion 20, the bead 42 snaps past and engages the seal outer portion 17 in an interfering engagement while being held from further downward movement by the neck top wall 16. At the same time the neck seal 20 abuts and seals the skirt inner wall 44 and the cap projection 62 impresses the seal 20 thereat to create the permanent impression 64 also in a sealing engagement. Upon subsequent removal of cap 10, it is snapped past the interference between the cap bead 42 and the neck seal 20 after it is first twisted to break the seal and release the vacuum which occurs when the cap projection 62 is peripherally displaced from the impression 64 which it has formed on the neck outer sealing surface 17. Optionally the cap 60 may have a threaded or biased lug engagement with the container neck 10 and the seal is broken by the projection 62 on initial twisting to facilitate the further twisting and cap removal. Additionally, the cap 60 may be threaded and/or the projection 62 may be on the lid 32 and create its impression on the neck seal 20 on its upper sealing surface 15.

Referring now to FIGS. 21 and 23 there is illustrated an embodiment of the invention wherein the container neck 10 described in FIG. 1 has been adapted to include a curled portion 70 at its rim which has a "U" shape cross section facing outwardly with an end 76 integral with the top 16 of the neck finish and a free end 72 with a curved intermediate portion 74 which provides a spring action upon axial compression to urge the cap thread 84 into compressive engagement with the neck thread 14 to stop the thread engagement at a predetermined location and to act as a locking and unlocking means to secure the cap and permit its removal. FIG. 22 shows the engagement of the neck 10 with a cap 30 having a lid 12 and one depending annular ring 88 which is a plug seal for engagement with the intermediate portion 74 of the curled spring portion 70, and a second depending annular ring 86 which is adapted to depress the free end 72 in a spring engagement to unlock the cap thread 84 from the neck thread 14. In this manner the container curled spring portion 70 provides both an effective seal and an effective spring action for the practice of the child resistant cap described in my application being filed simultaneously herewith, Ser. No. 063,119, the disclosure of which is incorporated herein by reference. Alternatively, the curled spring portion 70 may be produced in the original molding of the container neck 10 using suitable shaped blow, injection or other molds without a subsequent curling operation as described for the neck sealing portion 20 in FIGS. 5 and 6.

Referring now to FIG. 21, there is shown a neck finish 10 with a positive locking means 84 and a positive stopping means 82 included in a neck projection 80. When the cap 30 of FIG. 22 is applied to the neck finish 10, the threading operation continues until the neck stopping means face 82 stops further thread movement by engaging the cap stopping means face 90 whereupon the neck locking means 84 is in opposition to the cap locking means 94. In order to disengage such opposition, the cap 30 must be pressed axially against the neck 10 whereupon the curved spring portion 70 compresses to allow the cap locking means 94 to pass the neck locking means 84 when turned.

The curled portion is adapted to provide significant axial compression of at least about 0.030, preferably about 0.030 to 0.070 inches to allow for a significant butressing area on the locking and stopping surfaces and significant axial motion to effect their engagement and disengagement.

I claim:

1. A container and cap for receiving, housing and discharging a product comprising:

(a) an opening for receiving or discharging the product;

(b) a neck surrounding the opening including a rim;

(c) an annular projection integral with and extending from said rim having a curled free end portion for sealingly engaging the cap after the cap is placed on said neck to close the container; and (d) mechanical means on the outer surface of said neck spaced from said annular projection for engaging the cap for closing and opening the container.

2. The container of claim 1, wherein the annular projection is a ring having a cross-sectional shape selected from a U, J or O shape.

3. The container of claim 1, wherein said curled free end portion is curved outwardly from the opening of the container.

4. The container of claim 1, wherein said curled free end portion is curved inwardly toward the opening of the container.

5. A container and cap for receiving, housing and discharging a product wherein:

(a) said container comprises;

(1) an opening for receiving or discharging the product, (2) a neck surrounding the opening including a rim, (3) an annular projection integral with and extending from said rim having a curled free end portion for sealingly engaging the cap after the cap is placed on the said neck to close the container, and (4) mechanical means spaced from annular projection for closing and opening the cap on and from the container; and (b) said cap comprises;

(1) a top wall, (2) engaging means integral with said top wall for sealingly engaging said curled free end portion of said annular projection after closing the cap on the container;

(3) an annular skirt depending from said top wall, and (4) mechanical means on the inner surface of said skirt for engaging said mechanical means on said neck for closing and opening the cap on and from the container.

6. The cap and container of claim 5, wherein said annular projection comprises a ring having a cross-sectional shape selected from a U, J or O shape.

7. The cap and container of claim 5, wherein said engaging means depends from the inner surface of said top wall of the cap to sealingly engage said annular projection as the cap is closed on the container.

8. The cap and container of claim 7, wherein said engaging means comprises a depending wall spaced inwardly from said skirt of the cap.

9. The cap and container of claim 5, wherein said annular projection is made of plastic.

10. A container and cap for receiving, housing and discharging a product wherein:

(a) said container comprises:

(1) an opening for receiving or discharging the product, (2) a neck surrounding the opening including a rim, and (3) a flexible, plastic annular projection integral with and extending from said rim having a curled free end portion for sealingly engaging the cap as the cap is placed on said neck to close the container; and (b) said cap comprises:

(1) a top wall, and (2) an outer peripheral skirt depending from said top wall, including an inner substantially annular surface, an annular bead projecting inwardly from said inner surface at the lower end of said skirt adapted to snap past and engage said flexible, plastic annular projection of the container to close the cap on the container with said flexible, plastic annular projection in engagement with said inner surface, and at least one thread about said inner surface between said bead and top wall and projecting outwardly from said inner surface to engage and form at least one substantially matching groove in said flexible, plastic annular projection whereupon the cap thereafter can be twisted off and on the container because of engagement between said engaging threads on the cap and in said flexible, plastic annular projection of the container.

11. The cap and container of claim 10, wherein said threads are discontinuous.

12. The cap and container of claim 10, wherein the cap is at an elevated temperature at the time it is snapped on the container to thereby facilitate the formation of the threads in said flexible, plastic annular projection of the container.

13. A container and cap for receiving, housing and discharging a product wherein:

(a) said container comprises:

(1) an opening for receiving or discharging the product, (2) a neck surrounding the opening including a rim, and (3) a flexible plastic annular projection integral with and extending from said rim having a curled free end portion for sealingly engaging the cap as the cap is placed on said neck to close the container; and (b) said cap comprises:

(1) a top wall, and (2) an outer peripheral skirt depending from said top wall, including an inner substantially annular surface, an annular bead projecting inwardly from said inner surface at the lower end of said skirt adapted to snap past and engage said flexible, plastic annular projection to close the cap on the container with said flexible, plastic annular projection in sealing engagement with said inner surface, and a projection extending outwardly from said inner surface adapted to create a permanent impression in said flexible plastic, annular projection of the container when the cap is closed on the container to form a fluid passageway when the cap on the closed container is twisted prior to removal from the container.

* * * * *